United States Patent [19]

Kulesza et al.

[11] Patent Number: 4,468,029

[45] Date of Patent: Aug. 28, 1984

[54] PORTABLE PNEUMATIC ACTION GAME

[75] Inventors: Ralph J. Kulesza; Wayne A. Kulesza; Henry Arias, all of Chicago; Harry Disko, South Barrington, all of Ill.

[73] Assignee: Marvin Glass & Associates, Chicago, Ill.

[21] Appl. No.: 447,283

[22] Filed: Dec. 6, 1982

[51] Int. Cl.[3] ..... A63F 7/00

[52] U.S. Cl. ..... 273/108; 273/86 D; 273/129 AP; 273/85 H

[58] Field of Search ..... 273/119 B, 86 D, 85 H, 273/129 AP, 108

[56] References Cited

U.S. PATENT DOCUMENTS

| | | | |
|---|---|---|---|
| 1,941,630 | 1/1934 | Smith | 273/129 AP X |
| 3,469,340 | 9/1969 | Breneman et al. | 273/86 D X |
| 3,643,953 | 2/1972 | Fixler | 273/119 B |
| 3,697,071 | 10/1972 | Anderson | 273/86 D |
| 4,042,243 | 8/1977 | Hoel et al. | 273/108 |
| 4,418,908 | 12/1983 | Kinberg | 273/16 E |

FOREIGN PATENT DOCUMENTS

| | | | |
|---|---|---|---|
| 561388 | 10/1932 | Fed. Rep. of Germany | 273/85 H |
| 588009 | 11/1933 | Fed. Rep. of Germany | 273/119 B |

*Primary Examiner*—Richard C. Pinkham
*Assistant Examiner*—Scott L. Brown
*Attorney, Agent, or Firm*—John S. Pacocha

[57] ABSTRACT

A portable pneumatic action game for two opposing players has a base including a central raised hollow core supporting a playing surface and oppositely extending end sills. The playing surface has an array of separate elongated channels, each with an aperture at each end. A transparent cover extends over all of the channels. Slots in the cover permit insertion of a playing piece into each channel. Slidably mounted on each of the sills is a manual air pump and nozzle which can be moved by the player along one end of the channel array to selectively register the nozzle in pneumatic communication with the aperture of one channel to propel the playing piece toward the opposite end. An opening is provided in the bottom of each channel adjacent each end for the playing piece to drop down into the hollow central core for later tallying of the respective players' scores.

20 Claims, 4 Drawing Figures

PORTABLE PNEUMATIC ACTION GAME

BACKGROUND OF THE INVENTION

1. Field of the Invention

This invention relates generally to portable pneumatic action games for opposing players.

2. Background Art

There have been a number of games developed in which pneumatic means are employed to move objects, including games for opposing players such as the one shown in U.S. Pat. No. 3,643,953 requiring a central source of compressed air such as an electrically driven pump and a series of different kinds of valves for moving a plurality of balls through a series of interconnected channels. This game is not readily portable nor is it easy to prepare for a successive round. Another pneumatic game for opposing players is shown in U.S. Pat. No. 4,325,555 in which each of two players operates a fixed, manual pump to supply pressure through a tube to a nozzle mounted for movement parallel to a fixed rod on which targets are mounted for rotation such that the target under attack remains at a fixed and equal distance between properly positioned nozzles. The latter games does not provide much variety in the play and would appear to leave in doubt which player scored. Moreover, the skill and strategy required to win could be mastered after a number of repetitions. There remains a need for a portable pneumatic action game that, while easy to prepare for play, provides challenges to the player of different skill in the actual play.

SUMMARY OF THE INVENTION

The present invention is concerned with providing a self-contained portable pneumatic action game that will provide challenges to the competitive players skills, opportunities to make strategy decisions, decisive scoring, and easy readying for another round to enhance the play and enjoyment of the game. These and other objects and advantages of the invention are achieved by providing a base with a central raised hollow core bearing a playing surface that is divided into an array of separate elongated channels, each channel having an aperture at each end with the base also supporting manual pump and nozzle means at each end are movable across the array of channels to selectively register the nozzle in pneumatic communication with one of the channels. A single, substantially rectangular solid, playing piece is insertable into each of the channels and the opposing players each try to move as many of the pieces across the entire length of the channel toward the opponent's end. An opening is provided in the bottom of each channel adjacent each end for the playing piece to drop down below the playing surface into the hollow central base for later tallying of the score.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
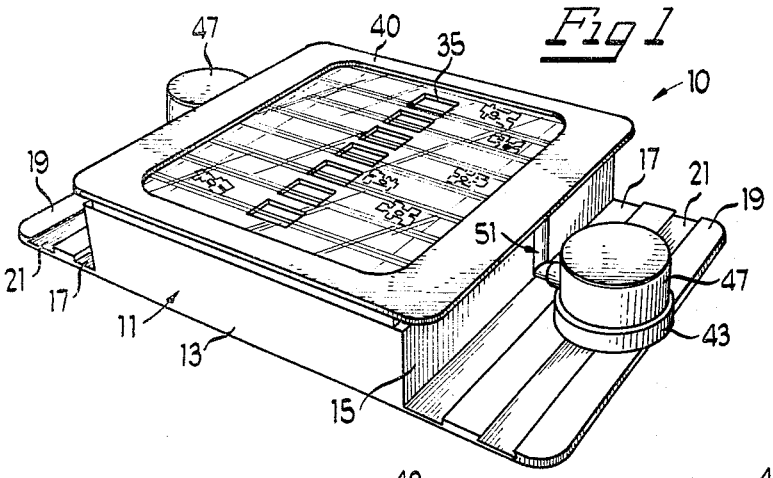
FIG. 1 is a perspective view of a game embodying the invention.
Figure 2:
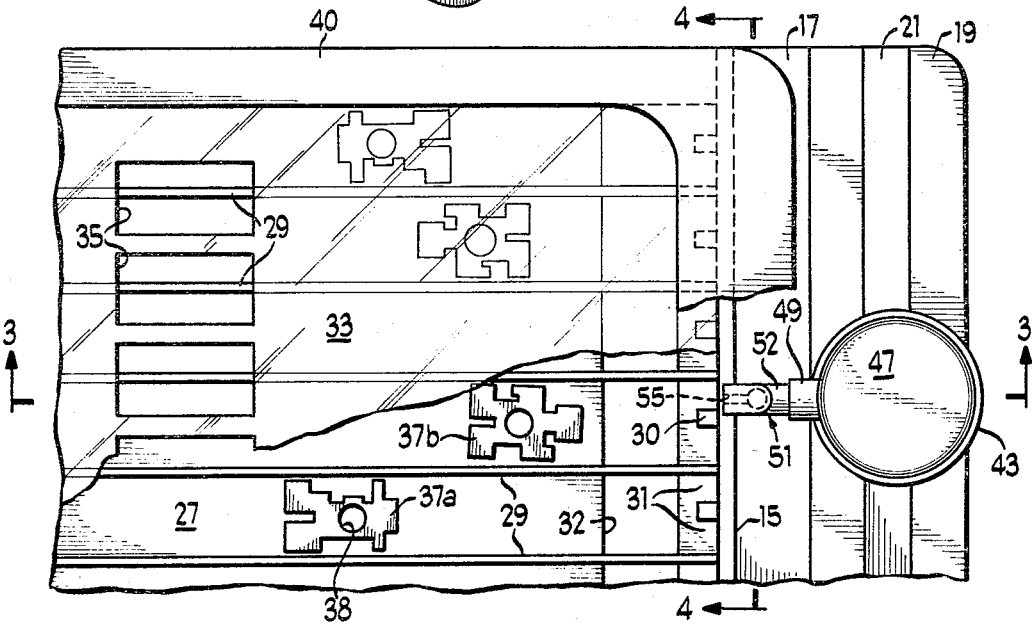
FIG. 2 is an enlarged partial top plan view of the game with part of the cover removed.

Referring now to the drawings in which like parts are designated by like reference characters throughout the several views, there is shown in FIG. 1 a portable pneumatic action game 10 for two opposing players. The game has an integrally formed plastic base 11 including upstanding spaced parallel opposed side panels 13 and upstanding spaced parallel opposed end panels 15 that are transverse to the side panels 13 and together with the side panels form a substantially rectangular, raised central core. Extending outwardly from the bottom of each of the end panels 15 is a sill 17 which includes a raised runway 19. Formed within the runway 19 is a keyway 21 which together with the sill 17 and runway 19 extends across substantially the entire width of the respective end panel 15.

Within the enclosure formed by the side panels 13 and the end panels 15 a supporting and dividing panel 23 essentially parallel to the end panels 15 extends from one side panel 13 to the other at the midpoint of the side panels. The panel 23 may be integrally formed as part of the base 11 or may be made as a separate piece that is connected to the base. All of the side panels 13, the end panels 15, and the center panel 23 are the same height. Supported on the plane formed by the tops of each of the side panels 13, end panels 15 and center panel 23 is a playing surface 25 which again may be integrally formed with the base or as a separate piece. The playing surface 25 is divided into any convenient number of separate elongated channels 27 between outside walls 28 by spaced, parallel upstanding walls 29. The outside walls 28 are thicker than the partitioning walls 29, but all of the walls 28 and 29 are of the same height and define channels that are substantially rectangular in all three dimensions and substantially identical. Although any number of such channels could be used, seven or eight channels have been found to provide entertaining and exciting play with the odd number of channels having the advantage of avoiding a tie.

The ends of each of the channels are open except for an upstanding restriction or barrier 30 at approximately the midpoint of the width of the channel dividing each end into a pair of apertures 31. Adjacent each end of each channel 27 is an opening 32 through the playing surface 25 that extends across the width of the channel. Across the top of all of the channels is a transparent cover 33 that is preferably formed of an impact resistant plastic. A number of substantially rectangular slots 35 are provided in the transparent cover 33 midway between the ends of each of the channels 27. Each slot is positioned over a wall 29 so that a playing piece 37 may be inserted into the middle of each of the inside channels through any one of two slots. Moreover, this positioning of the slots leaves a portion of the cover 33 remaining over the center of the elongated channel. This arrangement permits rapid reloading of the pieces 37 into the channels without materially affecting the flow of air and resulting propulsion of the piece along the channel. As an alternative the cover 33 could be hinged or otherwise removably mounted to permit removal for reloading of pieces 37 into the channels.

Playing pieces 37 are formed of relatively thin, lightweight plastic material. The pieces are substantially rectangular solids but may assume different designs such as 37*a* and 37*b* that are suggestive of the type of images displayed on the variety of video games that are increasing in popularity. The pieces are relatively thin and a hole 38 may be provided in the body of each of the pieces to reduce the weight. Other shapes could be employed as long as they cooperate with the size and shape of the channels 27, openings 32 and slots 35. The thickness and width of the playing pieces 37 must be sufficiently less than the height and width, respectively, of the channels 27 so that the piece may be propelled along the entire length of a channel and drop through the opening 32. The length of the pieces must be less than the length of the slots 35. However, the width of the slots may be less than one-half that of the pieces 37 since the pieces can be inserted into the channels at an angle.

Figure 3:
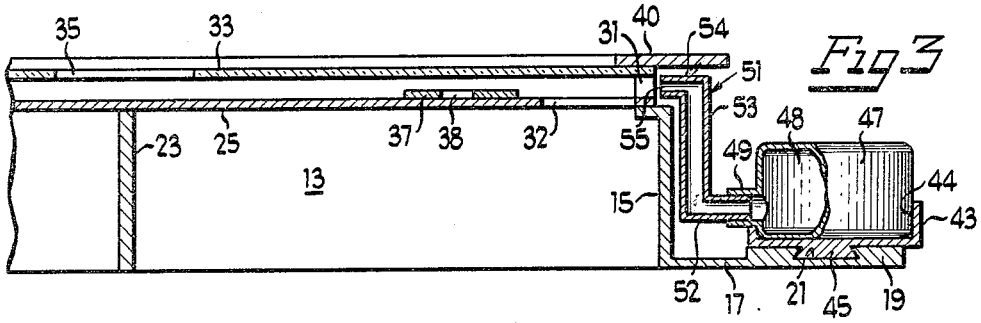
FIG. 3 is a partial sectional view taken substantially along line 3—3 of FIG. 2.
Figure 4:
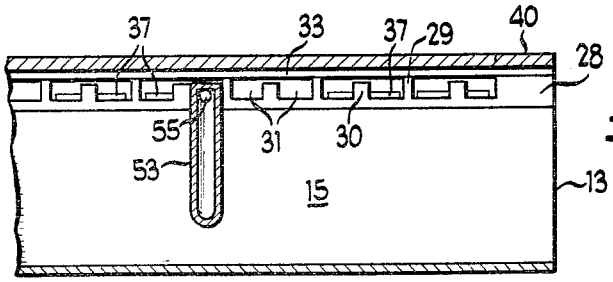
FIG. 4 is a partial sectional view taken substantially along line 4—4 of FIG. 2.

A protective rim 40 fits on top of the transparent cover 33 and frames an opening exposing the entire width of each of the channels 27 throughout most of the length of each of the channels. The outside edge of the rim 40 is flush with each of the side panels 13 but projects out beyond the end panels 15 as is best shown in FIG. 3.

A slidable carriage 43 having an upwardly facing opening 44 and a substantially centrally positioned downward projecting key 45 is mounted for side-to-side sliding movement on the runway 19. The key 45 fits into the keyway 21 which is transverse to the elongated channels 27 so as to effectively prohibit vertical movement of the carriage 43 as well as any front-to-back movement in the elongated dimension of the channels 27. Secured within the opening 44 of the carriage is a bulb or bellow pump 47 having a hollow pump chamber 48 formed of deformable resilient soft rubber or plastic with an inlet/outlet 49. A "Z" shaped conduit 51 is connected to the pump 47 with the lower, substantially horizontal, hollow portion 52 inserted into the inlet/-outlet 49. The other end of the lower horizontal leg 52 connects with a substantially vertical hollow stem 53 the upper end of which is connected to an upper substantially horizontal portion 54 with nozzle 55 at its end projecting inwardly toward one of the end panels 15 and the apertures 31 at the ends of the channels 27. The height of the vertical stem portion 53 is such that the nozzle 55 is in effective pneumatic communication with the apertures 31 at the end of a selected channel 27 if the pump 47 and carriage 43 are properly positioned along the runway 19. The portion of the protective rim 40 projecting beyond the end panel 15 shrouds and protects conduit 51, particularly the nozzle 55.

When the pump 47 is depressed by manual pressure, air is forced out through the inlet/outlet 49, conduit 51 and nozzle 55. If the pump and carriage have been properly laterally positioned the pumped air will move the playing piece 37 disposed in the channel away from the end at which the pump was activated and toward the opposite end. When the pressure on the pump is released the resilient, deformable material will return to its original shape and the pump chamber 48 will again fill-up with a reverse flow of air through the nozzle 55, conduit 51 and inlet/outlet 49. Upon being propelled to one end of a channel a playing piece 37 will drop through the hole 32 provided at each end of the channel. However, should the playing piece 37 be moved to one end under a great force it may rebound off of the stop 30 rather than dropping through the hole 32.

During play of the game the opposing players may elect to confine their contest to a single channel at a time until one player or the other succeeds in blowing the playing piece 37 through the respective opening 32. In such play, each player is attempting to move the piece 37 along the channel to the hole 32 while the opponent's pump 47 is recovering in order to again be able to exert an opposing pneumatic propelling force on the playing piece 37. As an alternative strategy, a player may elect to abandon a particular channel to an opponent in the hopes of blowing each piece 37 in a number of adjacent channels through the respective holes 32 and thus gain a higher score in spite of the sacrifice of the piece in the abandoned channel.

As the play of the game progresses and pieces drop down through the hole 32 at one end or the other end of each of the channels, the fallen pieces are retained on their respective player's ends by means of the dividing panel 23. Accordingly, at the conclusion of a round the players may simply lift the entire game 10 and count up the number of playing pieces each has successfully advanced against the opponent in order to determine the winner of the game. As previously indicated if there is an even number of channels a tie game would be possible while an odd number of channels eliminates the possibility of a tie.

The particular embodiment described and shown has channels 27 and playing pieces 37 of a particular shape. While it is important to maintain the hole 32 and the feed slot 35 small to maintain good air flow throughout the channel, the game of the present invention can be made and enjoyed with a variety of cooperating channels and playing piece shapes. While there has been illustrated and described a particular embodiment of the present invention, it will be apparent that various changes and modifications will occur to those skilled in the art. It is intended in the appended claims to cover all such changes and modifications as fall within the true spirit and scope of the present invention.

What is claimed as new and desired to be secured by Letters Patent is:

1. A portable pneumatic action game comprising:
- a base;
- a playing surface on the base;
- a plurality of separate elongated channels in side-by-side array on the playing surface;
- each of the channels having an aperture at each end;
- a transparent cover over the array;
- a combination pump and nozzle means mounted on the base at each end of the playing surface and being movable from side-to-side for selectively registering the nozzle in pneumatic communication with the aperture of each of the channels at the respective end; and
- a playing piece disposable in each of the channels for propulsion along the entire length of the channel in response to pneumatic pressure from the pump directed into the channel through the nozzle at the one end and ejection from the channel at the other end.

2. The portable pneumatic action game of claim 1 in which a discharge opening is provided at adjacent ends of each channel, the discharge opening being large enough to permit the playing piece to be discharged upon being propelled to an end of the channel by the pump and nozzle means.

3. The portable pneumatic action game of claim 2 in which the aperture has a restriction barring the ejection of the playing piece from the channel through the aperture.

4. The portable pneumatic action game of claim 3 in which the discharge opening is provided in the bottom of the channel.

5. The portable pneumatic action game of claim 1 in which a slot is provided in the cover intermediate the ends of each channel sufficiently large to permit the insertion of a playing piece into the channel but not so large as to prohibit the propulsion of the playing piece along the entire length of the channel by the pneumatic force of the communicating pump and nozzle means.

6. The portable pneumatic action game of claim 5 in which the slot is provided midway between the ends of each of the channels.

7. The portable pneumatic action game of claim 5 in which the width of the slot is less than the width of the channels.

8. The portable pneumatic action game of claim 1 in which the transparent cover is removable to permit access to the channels for insertion of the playing pieces.

9. The portable pneumatic action game of claim 1 in which the playing pieces and channels are substantially rectangular in three dimensions.

10. The portable pneumatic action game of claim 1 in which the playing pieces and the channels are both substantially rectangular in cross section.

11. The portable pneumatic action game of claim 1 in which the playing pieces and the channels are both substantially rectangular in plan view.

12. The portable pneumatic action game of claim 1 in which:

the base includes sills projected outwardly from each end;

each sill having a keyway transverse to the elongated channels;

the combination pump and nozzle means is on a carriage; and a key on the carriage mounts the pump and nozzle means on the base for the side-to-side movement.

13. A portable pneumatic action game comprising:

a base including a central hollow core formed of raised end panels and transverse side panels with a middle dividing panel parallel to the end panels;

a sill projecting outwardly from the bottom of each of the end panels;

a playing surface mounted on the top of the core;

the playing surface having a plurality of elongated open-ended channels of equal width formed by parallel spaced walls extending upwardly from the playing surface;

a transparent cover extending over the channels;

a combination manual pneumatic pump and nozzle slidably mounted on each of the sills such that the nozzle may be selectively registered with any one of the channels in pneumatic communication with an open end of the channel;

a playing piece disposable in each of the channels for propulsion along the entire length of the channel in response to pneumatic pressure directed into the channel through the nozzle in register with the channel;

means for inserting the playing piece into each channel; and means for automatically discharging the piece adjacent each end of the channel.

14. The portable pneumatic action game of claim 13 in which the means for automatically discharging the piece comprises a hole provided at adjacent ends of each channel, the hole being large enough to permit the playing piece to be discharged upon being propelled to an end of the channel by the pump and nozzle means.

15. The portable pneumatic action game of claim 13 in which the open-ended channel has a restriction barring the discharge of the playing piece from the channel through the open end.

16. The portable pneumatic action game of claim 15 in which the hole is provided through the bottom of the playing surface.

17. The portable pneumatic action game of claim 13 in which the means for inserting the playing piece comprises a slot provided in the cover intermediate the ends of each channel sufficiently large to permit the insertion of a playing piece into the channel but not so large as to prohibit the propulsion of the playing piece along the entire length of the channel by the pneumatic force of the communicating pump and nozzle.

18. The portable pneumatic action game of claim 17 in which the slot is provided midway between the ends of each of the channels.

19. The portable pneumatic action game of claim 17 in which the width of the slot is less than the width of the channel.

20. The portable pneumatic action game of claim 13 in which:

each sill has a keyway transverse to the elongated channels;

the combination pump and nozzle is on a carriage; and a key on the carriage mounts the pump and nozzle on the base for the sliding movement.

* * * * *